United States Patent [19]

Menown et al.

[11] Patent Number: 4,577,138

[45] Date of Patent: Mar. 18, 1986

[54] THYRATRONS

[75] Inventors: Hugh Menown, Chelmsford; Raymond P. Knight, Braintree, both of England

[73] Assignee: English Electric Valve Company, Chelmsford, England

[21] Appl. No.: 518,621

[22] Filed: Jul. 29, 1983

[30] Foreign Application Priority Data

Aug. 3, 1982 [GB] United Kingdom ..... 8222374

[51] Int. Cl.[4] ..... H01J 17/30

[52] U.S. Cl. ..... 313/599; 313/597; 313/449; 313/590

[58] Field of Search ..... 313/448, 449, 452, 460, 313/597, 600, 599, 590, 298, 297

[56] References Cited

U.S. PATENT DOCUMENTS

| | | | |
|---|---|---|---|
| 1,272,621 | 7/1918 | Chubb | 313/599 X |
| 2,072,637 | 3/1937 | Jobst | 313/297 X |
| 2,653,261 | 9/1953 | Watrous, Jr. | 313/597 X |

FOREIGN PATENT DOCUMENTS 774452 5/1957 United Kingdom .

*Primary Examiner*—Arthur Kellogg
*Attorney, Agent, or Firm*—Spencer & Frank

[57] ABSTRACT

Thyratrons have an anode and cathode with a control grid lying between them. A primary grid located between the control grid and cathode may be used to maintain a primary discharge between it and the cathode, and improve the operating characteristics of the thyratron. However, the primary discharge may penetrate into the region where the main discharge occurs and hence increase the probability of premature triggering of the thyratron.

By employing the invention, the penetration of the primary discharge into the main discharge region is reduced.

A primary grid comprises two elements which have apertures. The elements are arranged so that the apertures in one element do not overlap those in the other. Thus the primary discharge which penetrates through the first element is prevented from reaching the main discharge region by the second element.

9 Claims, 3 Drawing Figures

THYRATRONS

BACKGROUND OF THE INVENTION

1. Field of the Invention

This invention relates to thyratrons and more specifically to thyratrons of the kind having a so-called primary grid in addition to the normally provided control grid between cathode and anode, said primary grid being located between said control grid and the cathode. A thyratron is a gas-filled tube in which one or more control electrodes initiate, but do not limit, the anode current, except under certain operating conditions.

2. Description of Prior Art

A typical thryratron of the kind referred to as at present known is illustrated schematically in FIG. 1.

Referring to FIG. 1 the thyratron comprises a cathode 1 and an anode 2 having therebetween a control grid 3 and a primary grid 4. As will be seen, the primary grid 4 is located between the control grid 3 and the cathode 1 and has two arcuate coupling slots 4*a* and 4*b* therein.

A primary discharge represented at 5 is maintained between the primary grid 4 and the cathode 1 by means of a positive potential applied to the primary grid 4. The gap 6 between the control grid 3 and the primary grid 4 constitutes the region in which the main discharge occurs when the thryatron is triggered into its conductive state by applying a sufficiently high positive potential to the control grid 3. Once triggered, the thyratron remains in a conductive state until the anode potential is reduced to zero or made negative. Normally, in order to ensure that the thyratron is held in a non-conductive state prior to triggering, the control grid 3 is maintained at a negative potential, preventing the main discharge from occurring in the gap 6.

The purpose of providing the primary grid 4, and thus the ability to maintain a primary discharge between it and the cathode 1, is to reduce the time required for the anode current to reach its maximum value by decreasing the time required to produce the main discharge. The maintenance of the primary discharge also tends to reduce pulse to pulse jitter which is partly caused by vibration in the threshold voltage required to trigger the thyratron on different occasions.

Increasing the current in the primary discharge will shorten the anode current rise time but with the attendant disadvantage that the discharge may penetrate through the primary grid 4 into the gap 6 where the main discharge occurs, thus increasing the probability of producing the main discharge prematurely. This effect can be combated by increasing the negative bias voltage on the control grid 3 but above a certain limit this ceases to be effective.

BRIEF SUMMARY OF THE INVENTION

One object of the present invention is to provide an improved thryratron of the kind referred to in which the extent to which the discharge penetrates through the primary grid into the gap where the main discharge occurs is reduced.

According to this invention in its broadest aspect there is provided a thyratron comprising an anode; a cathode; a control grid positioned between said anode and said cathode; and a primary grid positioned between said control grid and said cathode, said primary grid having apertures spaced in a direction from cathode to anode in at least two planes, at least one aperture in one plane being staggered relative to at least one aperture in another plane whereby to inhibit penetration through said primary grid of the primary discharge maintained between said primary grid and said cathode prior to triggering.

According to a feature of this invention there is provided a thyratron comprising an anode; a cathode; a control grid positioned between said anode and said cathode; and a primary grid positioned between said control grid and said cathode, said primary grid being a multiple layer construction comprising at least two spaced apertured electrodes of which at least one aperture in one electrode is staggered relative to at least one aperture in another electrode whereby to inhibit penetration through said primary grid of the primary discharge maintained between said primary grid and the said cathode prior to triggering. This also serves to increase the degree of ionisation before the main discharge is struck, thus reducing the time taken for the final degree of ionisation to be reached, and therefore reducing the formative time of the main discharge.

Preferably each spaced apertured electrode has a plurality of apertures therein and preferably two apertures therein.

Preferably all of the apertures in one spaced apertured electrode are staggered relative to all of the apertures in another spaced apertured electrode.

It is also preferable that the extent to which an aperture in one spaced apertured electrode is staggered relative to an aperture in the other spaced apertured electrode is such that the first mentioned aperture is not overlapped by the other.

Preferably each apertured electrode has a pair of co-axial arcuate slots therein, the smaller diameter in the case of one pair of slots being greater than the larger diameter of the other pair of slots.

In one example of a thyratron in accordance with the present invention the aforementioned one pair of slots is in that apertured electrode which is nearer to the cathode.

In another example of thyratron in accordance with the present invention the aforementioned one pair of slots is in that apertured electrode which is further from the cathode.

Normally, said two apertured electrodes are electrically united.

DESCRIPTION OF THE PREFERRED EMBODIMENTS

The invention is further described with reference to FIGS. 2 and 3 of the accompanying drawings which illustrate in schematic fashion two examples of thyratrons in accordance with the present invention.

Figure 1:
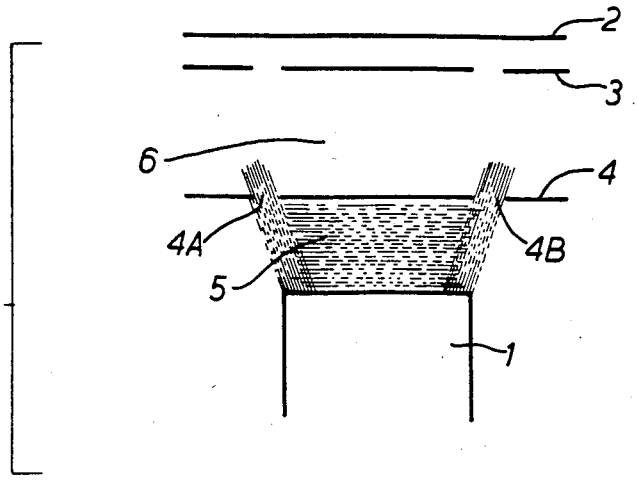
FIG. 1 is a schematic of a prior art thyratron.
Figure 2:
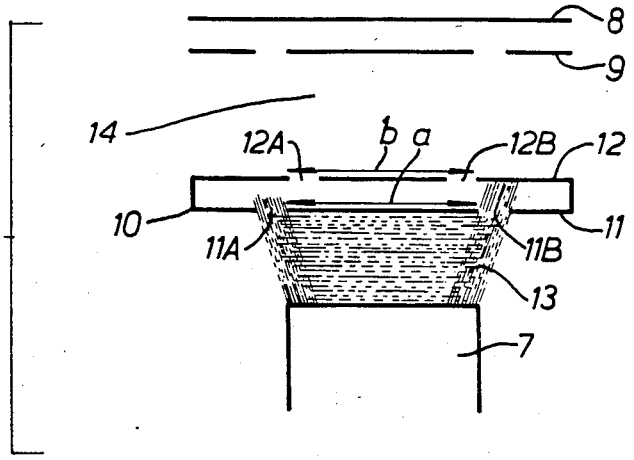
FIG. 2 is a schematic of one preferred embodiment of a thyratron according to the invention.
Figure 3:
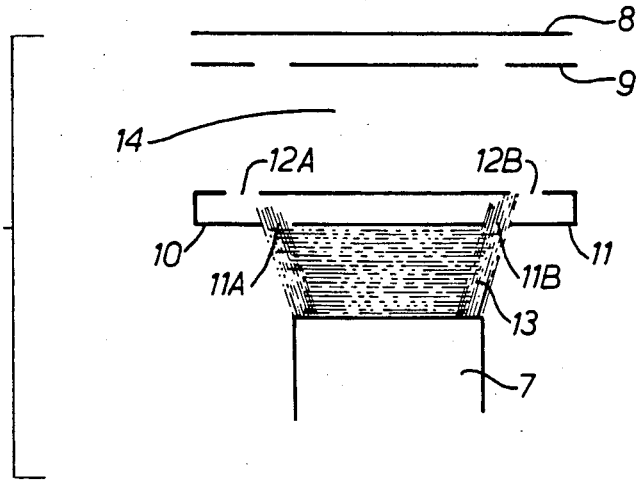
FIG. 3 is a schematic of another preferred embodiment of a thyratron according to the invention.

In FIGS. 2 and 3 like references are used for like parts.

Referring to FIG. 2, the thyratron in accordance with the invention thereby illustrated has a cathode 7, an anode 8 and a control grid 9 lying between them. A primary grid 10 is located between the control grid 9 and the cathode 7 and comprises first and second electrodes 11 and 12.

The electrodes 11 and 12 are parallel to each other and to the emissive surface of the cathode 7. The first electrode 11 lies between the second electrode 12 and the cathode 7 and has two co-axial arcuate apertures 11A and 11B of which the smaller diameter upon which they lie is denoted by a. The second element 12 also has two co-axial apertures 12A and 12B of which the larger diameter upon which they lie is denoted by b. Diameter a is greater than diameter b.

The apertures 11A, 11B, 12A and 12B, it will be noted, do not overlap along a direction parallel to the emissive surface of the cathode 7.

A primary discharge 13 is produced between the cathode 7 and primary grid 10 and penetrates through the apertures 11A and 11B in the first element 11. However, the discharge 13 does not penetrate through apertures 12A and 12B in the second element 12 because they do not overlap with the first apertures 11A and 11B. Hence the primary discharge 13 does not penetrate into a gap 14 between the control grid 9 and primary grid 10 where a main discharge occurs if the thyratron is in its conducting state.

Referring to FIG. 3, it will be seen that the example of the thyratron illustrated therein is essentially similar to that illustrated in FIG. 2, save that in this the smaller diameter upon which apertures 12A and 12B lie is greater than the larger diameter upon which apertures 11A and 11B lie.

We claim:

1. A gas-filled thyratron comprising an anode; a cathode; a control grid positioned between said anode and said cathode; and a primary grid positioned between said control grid and said cathode, said primary grid having apertures spaced in a direction from cathode to anode in at least two planes, at least one aperture in one plane being staggered relative to at least one aperture in another plane whereby to inhibit penetration through said primary grid of the primary discharge maintained between said primary grid and said cathode prior to triggering, said grids initiating but not limiting the anode current.

2. A gas-filled thyratron comprising an anode; cathode; a control grid positioned between said anode and said cathode; and a primary grid positioned between said control grid and said cathode, said primary grid being a multiple layer construction comprising at least two spaced apertured electrodes of which at least one aperture in one electrode is staggered relative to at least one aperture in another electrode whereby to inhibit penetration through said primary grid of the primary discharge maintained between said primary grid and said cathode prior to triggering, said grids initiating but not limiting the anode current.

3. A thyratron as claimed in claim 2 and wherein each spaced apertured electrode has a plurality of apertures therein.

4. A thyratron as claimed in claim 3 and wherein each spaced apertured electrode has two apertures therein.

5. A thyratron as claimed in claim 3 and wherein all the apertures in one spaced apertured electrode are staggered relative to all of the apertures in the other spaced apertured electrode.

6. A thyratron as claimed in claim 2 and wherein the extent to which an aperture in one spaced apertured electrode is staggered relative to an aperture in another spaced apertured electrode is such that the first mentioned aperture is not overlapped by the other.

7. A thyratron as claimed in claim 3 and wherein each apertured electrode has a pair of co-axial arcuate slots therein, the smaller diameter in the case of one pair of slots being greater than the larger diameter of the other pair of slots.

8. A thyratron as claimed in claim 7 and wherein the said one pair of slots is in that apertured electrode which is nearer to the cathode.

9. A thyratron as claimed in claim 7 and wherein the said one pair of slots is in that apertured electrode which is further from the cathode.

* * * * *